US012179818B2

(12) United States Patent
Li et al.

(10) Patent No.: US 12,179,818 B2
(45) Date of Patent: Dec. 31, 2024

(54) STATE TESTING METHOD FOR RAIL VEHICLE, ON-BOARD CONTROLLER, AND ZONE CONTROLLER

(71) Applicant: BYD COMPANY LIMITED, Guangdong (CN)

(72) Inventors: Yuanyuan Li, Shenzhen (CN); Weihua Liu, Shenzhen (CN); Jinghui Xia, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 262 days.

(21) Appl. No.: 18/071,300

(22) Filed: Nov. 29, 2022

(65) Prior Publication Data

US 2023/0086423 A1 Mar. 23, 2023

Related U.S. Application Data

(63) Continuation of application No. PCT/CN2021/094837, filed on May 20, 2021.

(51) Int. Cl.
*B61L 27/57* (2022.01)
*B61L 27/40* (2022.01)
*B61L 27/60* (2022.01)

(52) U.S. Cl.
CPC ..... *B61L 27/57* (2022.01); *B61L 27/40* (2022.01); *B61L 27/60* (2022.01)

(58) Field of Classification Search
CPC ..... B61L 27/57; B61L 27/40; B61L 27/60
See application file for complete search history.

(56) References Cited

U.S. PATENT DOCUMENTS 5,465,926 A * 11/1995 Brown ..... B61L 23/168 246/34 B
2017/0015337 A1* 1/2017 Seaton ..... B60L 15/2009
2019/0337543 A1* 11/2019 Corbo ..... B61L 27/40

FOREIGN PATENT DOCUMENTS

CN 109677453 A 4/2019
CN 110015322 A 7/2019
(Continued)

OTHER PUBLICATIONS

English Translation of International Search Report from PCT/CN2021/094837 dated Sep. 1, 2021 (2pages).

*Primary Examiner* — Jacob M Amick
(74) *Attorney, Agent, or Firm* — Calfee, Halter & Griswold LLP

(57) ABSTRACT

The present disclosure provides a state testing method for a rail vehicle, an on-board controller, and a zone controller. The state testing method for a rail vehicle includes: receiving a rail vehicle wake-up instruction; performing an on-board controller self-test to obtain an on-board controller self-test result; receiving a vehicle self-test result; receiving rail vehicle position information; outputting a static test instruction according to the on-board controller self-test result, the vehicle self-test result, and the rail vehicle position information; receiving a static test result; outputting a dynamic test instruction according to the static test result and the rail vehicle position information; receiving a dynamic test result; and outputting dynamic test completion status information according to the dynamic test result, and updating the dynamic test completion status information to a determination as to a dynamic test condition of other rail vehicles adjacent to a rail vehicle in real time through the ZC.

16 Claims, 5 Drawing Sheets

(56) References Cited

FOREIGN PATENT DOCUMENTS

| | | | |
|---|---|---|---|
| CN | 110816594 | A | 2/2020 |
| CN | 110843867 | A | 2/2020 |
| CN | 110901702 | A | 3/2020 |

* cited by examiner

STATE TESTING METHOD FOR RAIL VEHICLE, ON-BOARD CONTROLLER, AND ZONE CONTROLLER

CROSS-REFERENCE TO RELATED APPLICATIONS

The present disclosure is a bypass continuation of PCT International Application No. PCT/CN2021/094837, filed on May 20, 2021, which claims priority to Chinese Patent Application 202010475213.5 on May 29, 2020 and entitled "STATE TESTING METHOD FOR RAIL VEHICLE, ON-BOARD CONTROLLER, AND ZONE CONTROLLER". The entire contents of the above-referenced applications are incorporated herein by reference.

FIELD

The present disclosure belongs to the field of rail transit, and more specifically, to a state testing method for a rail vehicle, an on-board controller, and a zone controller (ZC).

BACKGROUND

Autonomous driverless trains enter a sleep state after arriving at a garage and ending operation. Before next operation, the trains need to be positioned and initialized, and need to establish communication with the ground device and perform static and dynamic tests under the protection of the ground device, through a wake-up process. After the tests are completed, the trains receive authorization information sent by the ground device to start operation.

SUMMARY

The present disclosure provides a state testing method for a rail vehicle, an on-board controller, and a ZC.

An embodiment of a first aspect of a first aspect of the present disclosure provides a state testing method for a rail vehicle, which is used for state testing of multiple rail vehicles on a same station track during wake-up and includes: receiving a rail vehicle wake-up instruction; performing an on-board controller self-test according to the rail vehicle wake-up instruction, to obtain an on-board controller self-test result; receiving a vehicle self-test result; receiving rail vehicle position information; outputting a static test instruction according to the on-board controller self-test result, the vehicle self-test result, and the rail vehicle position information, causing the rail vehicle to perform a static test; receiving a static test result; outputting a dynamic test instruction according to the static test result and the rail vehicle position information, causing the rail vehicle to perform a dynamic test; receiving a dynamic test result; and outputting dynamic test completion status information according to the dynamic test result, and updating the dynamic test completion status information to a determination as to a dynamic test condition of other rail vehicles adjacent to the rail vehicle in real time through a ZC.

In some examples of the present disclosure, the performing an on-board controller self-test according to the rail vehicle wake-up instruction, to obtain an on-board controller self-test result includes: outputting on-board controller self-test failure information to a dispatch center and outputting a safety braking instruction to the rail vehicle if the on-board controller self-test result indicates a failure; and outputting and retaining on-board controller self-test success information if the on-board controller self-test result indicates a success.

In some examples of the present disclosure, the state testing method for a rail vehicle further includes: sending activation information to a cab of the rail vehicle when the on-board controller self-test result and the vehicle self-test result both indicate a success; maintaining the braking instruction and outputting the static test instruction when receiving, within a preset time, activation signal fed back by the cab, causing the rail vehicle to perform the static test; and feeding back fault information to the dispatch center when receiving, within the preset time, no activation signal fed back by the cab.

In some examples of the present disclosure, the outputting a static test instruction according to the on-board controller self-test result, the vehicle self-test result, and the rail vehicle position information, causing the rail vehicle to perform a static test includes: outputting the static test instruction when the on-board controller self-test result and the vehicle self-test result indicate a success and the rail vehicle position information is correct, causing the rail vehicle to perform the static test.

In some examples of the present disclosure, the outputting a dynamic test instruction according to the static test result and the rail vehicle position information, causing the rail vehicle to perform a dynamic test includes: sending a dynamic test authorization application to the ZC when the static test succeeds and the rail vehicle position information is reliable; and receiving a dynamic test authorization instruction, and outputting the dynamic test instruction, causing the rail vehicle to perform the dynamic test.

An embodiment of a second aspect of the present disclosure provides a state testing method for a rail vehicle, which is used for state testing of multiple rail vehicles on a same station track during wake-up and includes: receiving dynamic test completion status information, where the dynamic test completion status information is obtained by: receiving, by an on-board controller, a rail vehicle wake-up instruction to perform an on-board controller self-test, outputting a static test instruction according to an on-board controller self-test result and a received vehicle self-test result, outputting a dynamic test instruction according to a received static test result and received rail vehicle position information, and obtaining the dynamic test completion status information according to a received dynamic test result; and sending the dynamic test completion status information to other rail vehicles adjacent to the rail vehicle.

In some examples of the present disclosure, the above state testing method for a rail vehicle further includes: receiving a dynamic test authorization application; determining whether the rail vehicle satisfies a determination as to a dynamic test condition; receiving a dynamic test determination result; and outputting a dynamic test authorization instruction according to the dynamic test determination result.

In some examples of the present disclosure, in a case that positions of the other rail vehicles adjacent to the rail vehicle are reliable, the determination as to a dynamic test condition includes: the current rail vehicle satisfies a condition for the dynamic test when none of the other rail vehicles adjacent to the rail vehicle sends the dynamic test authorization application; the current rail vehicle does not satisfy the condition for the dynamic test when any of the other rail vehicles adjacent to the rail vehicle sends the dynamic test authorization application but does not send the dynamic test completion status information; and the current rail vehicle satisfies the condition for the dynamic test when all of the other rail vehicles adjacent to the rail vehicle send the dynamic test authorization application and send the dynamic test completion status information.

An embodiment of a third aspect of the present disclosure provides an on-board controller, including: a first receiving module, configured to receive a rail vehicle wake-up instruction, rail vehicle position information, an on-board controller self-test result, a vehicle self-test result, a static test result, and a dynamic test result; a self-test module, configured to perform an on-board controller self-test according to the rail vehicle wake-up instruction; and an output module, configured to: output a static test instruction according to the on-board controller self-test result, the vehicle self-test result, and the rail vehicle position information, causing the rail vehicle to perform a static test; output a dynamic test instruction according to the static test result and the rail vehicle position information, causing the rail vehicle to perform a dynamic test; and output dynamic test completion status information according to the dynamic test result, and update the dynamic test completion status information to a determination as to a dynamic test condition of other rail vehicles adjacent to the rail vehicle in real time through a ZC.

An embodiment of a fourth aspect of the present disclosure provides a ZC, including: a second receiving module, configured to receive dynamic test completion status information, where the dynamic test completion status information is obtained by: receiving, by an on-board controller, a rail vehicle wake-up instruction to perform an on-board controller self-test, outputting a static test instruction according to an on-board controller self-test result and a received vehicle self-test result, outputting a dynamic test instruction according to a received static test result and received rail vehicle position information, and obtaining the dynamic test completion status information according to a received dynamic test result; and a sending module, configured to send the dynamic test completion status information to other rail vehicles adjacent to the rail vehicle.

An embodiment of a fifth aspect of the present disclosure provides a controller, including a memory, a processor, a receiver, a transmitter, and a computer program stored in the memory and executable on the processor. When the processor executes the computer program, the state testing method for a rail vehicle in the embodiment of the first aspect of the present disclosure or the embodiment of the second aspect of the present disclosure is implemented.

An embodiment of a sixth aspect of the present disclosure provides a computer-readable storage medium, storing a computer program. When the computer program is executed by a processor, the state testing method for a rail vehicle in the embodiment of the first aspect of the present disclosure or the embodiment of the second aspect of the present disclosure is implemented.

The additional aspects and advantages of the present disclosure will be provided in the following description, some of which will become apparent from the following description or may be learned from practices of the present disclosure.

DETAILED DESCRIPTION

To make the technical problems resolved by the present disclosure, technical solutions, and advantageous effects clearer and more comprehensible, the following further describes the present disclosure in detail with reference to the accompanying drawings and embodiments. It is to be understood that the specific embodiments described herein are merely used for describing the present disclosure, but are not intended to limit the present disclosure.

In the related art, during a wake-up from sleep test of a vehicle, the wake-up from sleep test is performed on only a single train. Therefore, the wake-up from sleep testing efficiency is relatively low, affecting the operating efficiency of trains.

The embodiments of the present disclosure are described below in detail. Examples of the embodiments are shown in the accompanying drawings, and same or similar reference signs in all the accompanying drawings indicate same or similar components or components having same or similar functions. The embodiments described below with reference to the accompanying drawings are exemplary and used only for explaining the present disclosure, and should not be construed as a limitation on the present disclosure.

A state testing method for a rail vehicle, an on-board controller, and a zone controller (ZC) in the embodiments of the present disclosure are described in detail below with reference to FIGS. 1-8.

Figure 1:
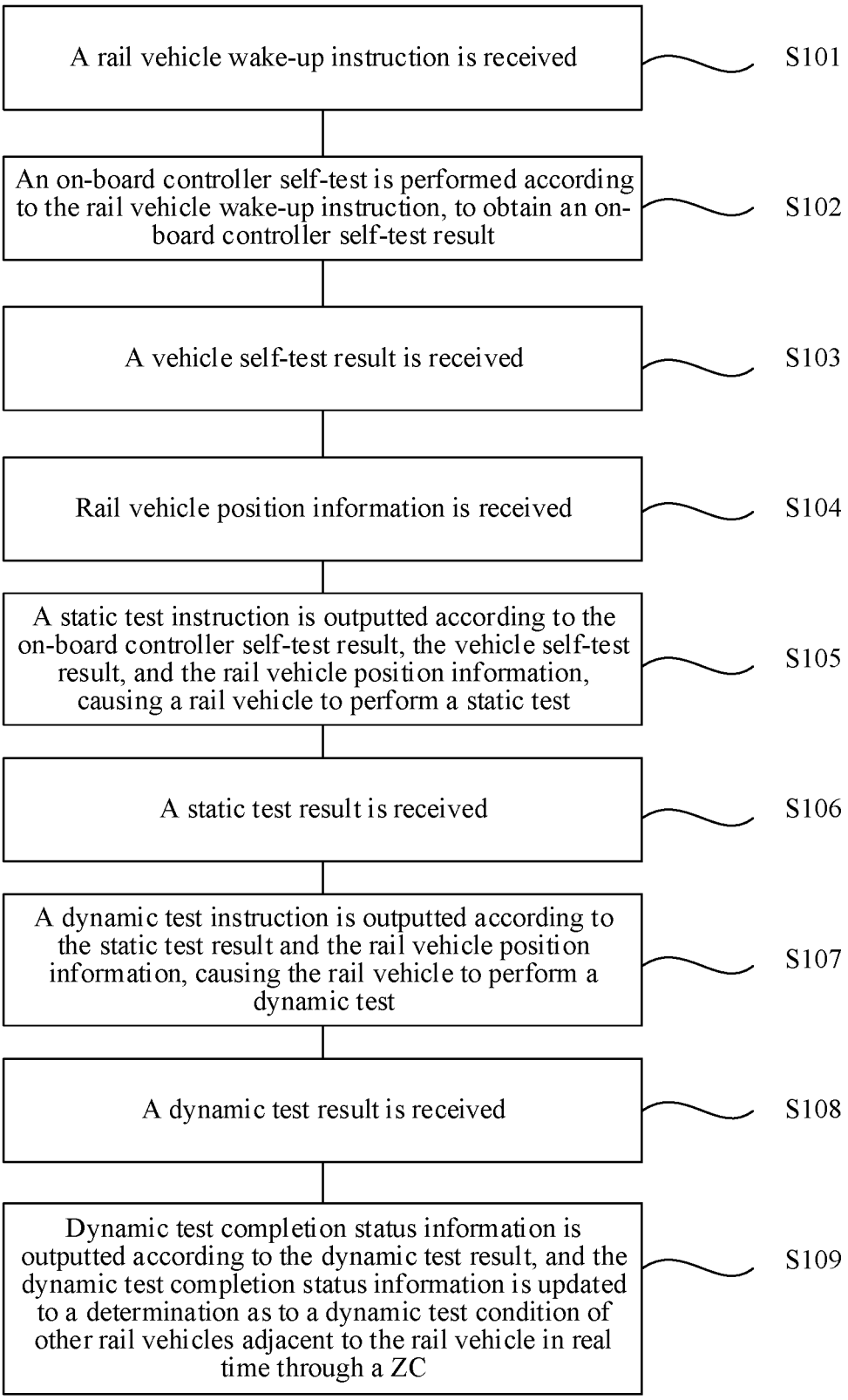
FIG. 1 is a schematic diagram of a state testing method for a rail vehicle according to an embodiment of the present disclosure.

In some embodiments, as shown in FIG. 1, the state testing method for a rail vehicle includes the following steps:

S101: A rail vehicle wake-up instruction is received.

Before a state test of a rail vehicle, an automatic train supervision (ATS) needs to deliver a wake-up instruction to a wake-up from sleep module according to a dispatch/departure plan or manually. All trains on a same station track should be simultaneously woken up. After receiving a wake-up command delivered by the ATS, a wake-up from sleep module sends the wake-up instruction to the vehicles through a hard wire to power on all of the trains, and also sends the wake-up instruction to an on-board controller, that is, the on-board controller receives the rail vehicle wake-up instruction.

S102: An on-board controller self-test is performed according to the rail vehicle wake-up instruction, to obtain an on-board controller self-test result.

In some embodiments, after the on-board controller receives the rail vehicle wake-up instruction, the on-board controller requires a power-on self-test. The on-board controller self-test includes but is not limited to: testing of an operating state of a transponder transmission unit (Balise Transit Module, BTM), electronic map verification, internal readback of a safety output board, external recovery of a safety output relay, and speed sensor state testing.

In some implementations, step S102 further includes:

outputting on-board controller self-test failure information to a dispatch center and outputting a safety braking instruction to the vehicle if the on-board controller self-test result indicates a failure; and outputting and retaining on-board controller self-test success information if the on-board controller self-test result indicates a success.

When the on-board controller of the rail vehicle completes the self-test, two results may be generated. One is the failure of the on-board controller self-test. Reasons for the failure of the on-board controller self-test include an electronic map verification failure, a speed sensor state test failure, and the like. When the on-board controller self-test fails, the on-board controller outputs the self-test failure information and reports the self-test failure information to the ATS. The ATS displays the on-board controller self-test failure, and sends the on-board controller self-test failure information to a dispatch center. The dispatch center prompts the on-board controller self-test failure and notifies maintenance personnel of maintenance. The other is the on-board controller self-test success. When the on-board controller self-test succeeds, a vehicle self-test result is received.

S103: A vehicle self-test result is received.

In some embodiments, during the wake-up of the rail vehicle, the vehicle requires a power-on self-test. The power-on self-test of the vehicle includes but is not limited to: testing of a communication state between a train control and management system (TCMS) and train traction brake, a door system self-test, air conditioning system self-test, a smoke alarm system self-test, a passenger information system (PIS) self-test, public address (PA) self-test, a closed-circuit television (CCTV) self-test, a tire pressure monitoring system self-test, an obstacle detection system self-test, a battery system self-test, a lighting system self-test, and a whistle system self-test. After the vehicle self-test is completed, the vehicle self-test result is fed back to the on-board controller. When the vehicle self-test fails, vehicle self-test failure information is reported to the ATS. The ATS displays the vehicle self-test failure, and sends the vehicle self-test failure information to the dispatch center. The dispatch center prompts the vehicle self-test failure and notifies the maintenance personnel of maintenance. When the vehicle self-test succeeds, a next operation is performed.

S104: Rail vehicle position information is received.

In some embodiments, when the on-board controller and the vehicle both succeed in the power-on self-test, the on-board controller may send a static test instruction to perform a static test. It should be noted that, before the static test, it is necessary to test whether a position of the rail vehicle is correct. It is determined whether a position of the rail vehicle in an anti-power-down area is the same as a position obtained by a wake-up from sleep transponder. If the position is the same and is within a sleep window, the static test is performed. Otherwise, a wake-up failure is outputted.

S105: A static test instruction is outputted according to the on-board controller self-test result, the vehicle self-test result, and the rail vehicle position information, causing the rail vehicle to perform a static test.

It should be noted herein that the static test includes but is not limited to a parking brake application test, a holding brake application test, a holding brake relief test, an emergency brake application test, an emergency brake relief test, an all common application test, an all common brake relief test, a 75% common brake application test, a traction enable test, a traction removal test, a parking brake relief test, a lighting test, a train announcement test, a left door open test, a right door open test, and all train door close test. That is to say, the static test includes but is not limited to the following steps: performing a static test on a braking system, and determining whether the braking system is faulty; performing a static test on a traction system, and determining whether the traction system is faulty; performing a static test on an announcement system, and determining whether the announcement system is faulty; and performing a static test on a door system, and determining whether the door system is faulty.

In some implementations, step S105 further includes:

outputting the static test instruction when the on-board controller self-test result and the vehicle self-test result indicate a success and the rail vehicle position information is correct, causing the rail vehicle to perform the static test.

In some embodiments, after the on-board controller self-test and the power-on self-test of the vehicle both succeed, a static test may be performed. At this time, the on-board controller needs to determine whether the static test can be performed.

The on-board controller determines whether the rail vehicle satisfies a static test condition. The static test condition includes but is not limited to: the on-board controller and the vehicle both succeed in the power-on self-test, the rail vehicle is parked in the sleep window and in the correct position, and there is no abnormality in the communication of the on-board controller.

When determining that the rail vehicle satisfies the static test condition, the on-board controller outputs the static test instruction causing the rail vehicle to perform the static test. When the on-board controller determines that the rail vehicle does not satisfy the static test condition, the static test cannot be performed.

In some embodiments, the method further includes:

sending activation information to a cab of the rail vehicle when the on-board controller self-test result and the vehicle self-test result both indicate a success;

maintaining the braking instruction and outputting the static test instruction when receiving, within a preset time, activation signal fed back by the cab, causing the rail vehicle to perform the static test; and feeding back fault information to the dispatch center when receiving, within the preset time, no activation signal fed back by the cab.

In some embodiments, the rail vehicle generally has a cab. When the on-board controller self-test and the vehicle self-test both succeed, the cab at an end of the rail vehicle is activated first. After activating the cab, the cab needs to feed back an activation signal. If the activation signal fed back by the cab is received within the preset time, it means that the cab is normally activated. At this time, the on-board controller keeps outputting a braking instruction to keep the rail vehicle in a static state, and outputs the static test instruction, causing the rail vehicle to perform the static test. If no activation signal fed back by the cab feedback is received within the preset time, the fault information is fed back to notify the maintenance personnel of repair in time.

S106: A static test result is received.

In some embodiments, after the rail vehicle completes the static test, the static test result is finally received, and corresponding actions are performed according to the static test result. When the static test succeeds, a dynamic test instruction may be outputted. When the static test fails, a static test failure instruction is outputted, all fault information is outputted, and the fault information is sent to the ATS. The ATS receives and forwards the information to the dispatch center. The dispatch center displays the static test result and all of the fault information during the test, causing the maintenance personnel to perform corresponding maintenance.

S107: A dynamic test instruction is outputted according to the static test result and the rail vehicle position information, causing the rail vehicle to perform a dynamic test.

In some embodiments, when the static test succeeds, the dynamic test instruction may be outputted. It should be noted that, before the dynamic test instruction is outputted, it is necessary to determine whether the rail vehicle satisfies a determination as to a dynamic test condition. If the rail vehicle does not satisfy the determination as to a dynamic test condition, a movement authorization cannot be granted. In this case, the dynamic test cannot be performed.

In some implementations, step S107 further includes:

sending a dynamic test authorization application to the ZC when the static test succeeds and the rail vehicle position information is reliable; and receiving a dynamic test authorization instruction, and outputting the dynamic test instruction, causing the rail vehicle to perform the dynamic test.

In some embodiments, after the static test is completed, an application for the dynamic test may be send. In this case, the on-board controller needs to send a dynamic test request to the ZC to apply for a dynamic test authorization of the ZC.

The ZC determines whether the rail vehicle satisfies a dynamic test condition. The dynamic test condition includes but is not limited to: the static test succeeds, the rail vehicle position information is reliable, and the adjacent rail vehicles do not perform a dynamic test and are under a reliable braking state. The rail vehicle position information being reliable means that the rail vehicle position information is correct and a distance between the adjacent rail vehicle positions does not impede the dynamic test.

When determining that the rail vehicle satisfies the dynamic test condition, the ZC sends a dynamic test authorization instruction to the on-board controller. The on-board controller receives the dynamic test authorization instruction, and outputs the dynamic test instruction, causing the rail vehicle to perform the dynamic test. When the ZC determines that the rail vehicle does not satisfy the dynamic test condition, the dynamic test authorization is not granted.

S108: A dynamic test result is received.

In some embodiments, when the rail vehicle completes the dynamic test, the on-board controller receives the dynamic test result, and performs corresponding actions according to the dynamic test result. When the dynamic test succeeds, dynamic test completion status information may be outputted, that is, a next step is performed. When the dynamic test fails, a dynamic test failure instruction is outputted, all fault information is outputted, and the fault information is sent to the ATS. The ATS receives and forwards the information to the dispatch center. The dispatch center displays the dynamic test result and all of the fault information during the test, causing the maintenance personnel to perform corresponding maintenance.

S109: Dynamic test completion status information is outputted according to the dynamic test result, and the dynamic test completion status information is updated to a determination as to a dynamic test condition of other rail vehicles adjacent to the rail vehicle in real time through a ZC.

In some embodiments, in step S101, during the receipt of the rail vehicle wake-up instruction, all of the rail vehicles on the same station track are simultaneously woken up. Therefore, during dynamic test of all of the rail vehicles on the same station track, since the movement authorization needs to be granted, the position states of the front and rear vehicles need to be taken into consideration. If the adjacent rail vehicles simultaneously perform a dynamic test, safety accidents are likely to occur. Therefore, during the determination as to a dynamic test condition, it is necessary to determine whether the adjacent rail vehicles are performing a dynamic test.

In some embodiments, the method further includes:

outputting the dynamic test completion status information to the ZC when the dynamic test succeeds.

When the rail vehicle needs to perform a dynamic test, the dynamic test authorization instruction is received. The dynamic test authorization instruction is an instruction delivered by the ZC when determining to perform the dynamic test according to a completion status of the dynamic test of the adjacent rail vehicles.

In some embodiments, when any rail vehicle on the same station track completes the dynamic test, the dynamic test completion status information needs to be sent to the ZC.

When a current rail vehicle needs to perform a dynamic test, the ZC needs to determine whether to authorize the current rail vehicle to perform the dynamic test. In this case, the determination of the movement authorization to the rail vehicle is required to include whether the adjacent rail vehicles are performing a dynamic test. An important condition for determining whether the adjacent rail vehicles are performing the dynamic test is a completion status of the dynamic test.

In some embodiments, when the positions of the adjacent rail vehicles are reliable, the determination as to a dynamic test condition includes:

the current rail vehicle satisfies a condition for the dynamic test when none of the adjacent rail vehicles sends the dynamic test authorization application;

the current rail vehicle does not satisfy the condition for the dynamic test when any of the adjacent rail vehicles sends the dynamic test authorization application but does not send the dynamic test completion status information; and the current rail vehicle satisfies the condition for the dynamic test when all of the adjacent rail vehicles send the dynamic test authorization application and send the dynamic test completion status information.

In some embodiments, it may be understood that the positions of the adjacent rail vehicles being reliable means that the rail vehicle position information is correct and the distance between the adjacent rail vehicle positions does not impede the dynamic test.

In this case, during the determination whether the current rail vehicle can perform the dynamic test, it is not necessary to consider distances between the adjacent rail vehicles and the current rail vehicle. If the positions of the adjacent rail vehicles are unreliable, dynamic test is not performed to prevent traffic accidents.

In some embodiments, when the positions of the adjacent rail vehicles are reliable and none of the adjacent rail vehicles sends the dynamic test application, it means that none of the adjacent rail vehicles is performing the dynamic test, which has no impact on the current rail vehicle. Therefore, the current rail vehicle can perform the dynamic test. If any of the adjacent rail vehicles sends the dynamic test application but does not send the dynamic test completion status, it means that this rail vehicle is performing the dynamic test and does not complete the dynamic test. Therefore, the current rail vehicle does not perform the dynamic test, to prevent a traffic accident as a result of two rail vehicles simultaneously performing a dynamic test. When the adjacent rail vehicles all send the dynamic test application and the adjacent rail vehicles all send the dynamic test completion status, it means that the adjacent rail vehicles complete the dynamic test. Therefore, the dynamic test authorization can be granted to the current rail vehicle.

In some embodiments, it should be understood that a rail vehicle generally has cabs at both ends, and the static test and the dynamic test are required to be performed on the cabs at the both ends. Generally, the cab at one end of the rail vehicle needs to be activated first, and a static test and then a dynamic test are performed on the cab at the end after an activation signal fed back by the cab at the end is received. When the static test and the dynamic test of the cab at the one end is completed, the same operations are performed on the cab at the other end. After the static test and the dynamic test of the cabs at the both ends are completed, the rail vehicle enters an automatic operation mode and sends the dynamic test completion status information to the ZC.

Figure 2:
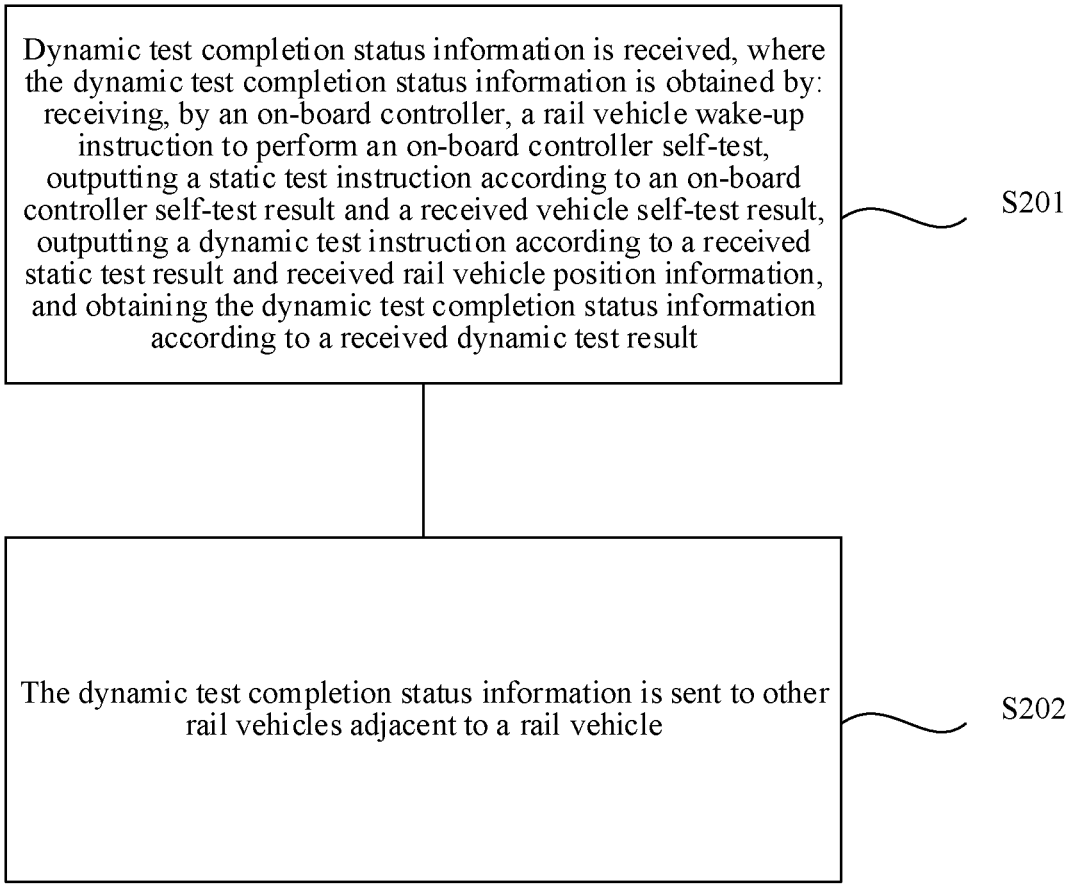
FIG. 2 is a schematic diagram of another state testing method for a rail vehicle according to an embodiment of the present disclosure.

In some embodiments, as shown in FIG. 2, the state testing method for a rail vehicle includes the following steps:

S201: Dynamic test completion status information is received, where the dynamic test completion status information is obtained by: receiving, by an on-board controller, a rail vehicle wake-up instruction to perform an on-board controller self-test, outputting a static test instruction according to an on-board controller self-test result and a received vehicle self-test result, outputting a dynamic test instruction according to a received static test result and received rail vehicle position information, and obtaining the dynamic test completion status information according to a received dynamic test result.

In some embodiments, the ZC receives the dynamic test completion status information, and the dynamic test completion status information is sent by the on-board controller. A specific method for generating the dynamic test completion status information by the on-board controller has been described in detail in the above steps, and therefore is not repeated herein.

S202: The dynamic test completion status information is sent to other rail vehicles adjacent to the rail vehicle.

In some embodiments, the state testing method for a rail vehicle further includes:

receiving a dynamic test authorization application;

determining whether the rail vehicle satisfies a determination as to a dynamic test condition;

receiving a dynamic test determination result; and outputting a dynamic test authorization instruction according to the dynamic test determination result.

After receiving the dynamic test authorization application sent by the on-board controller, the ZC needs to determine whether the rail vehicle satisfies the determination as to a dynamic test condition.

The determination as to a dynamic test condition is as follows:

When the positions of the adjacent rail vehicles are reliable and none of the adjacent rail vehicles sends the dynamic test application, it means that none of the adjacent rail vehicles is performing the dynamic test, which has no impact on the current rail vehicle. Therefore, the current rail vehicle can perform the dynamic test. If any of the adjacent rail vehicles sends the dynamic test application but does not send the dynamic test completion status, it means that this rail vehicle is performing the dynamic test and does not complete the dynamic test. Therefore, the current rail vehicle does not perform the dynamic test, to prevent a traffic accident as a result of two rail vehicles simultaneously performing a dynamic test. When the adjacent rail vehicles all send the dynamic test application and the adjacent rail vehicles all send the dynamic test completion status, it means that the adjacent rail vehicles complete the dynamic test. Therefore, the dynamic test authorization can be granted to the current rail vehicle.

After it is finally determined that the dynamic test can be performed according to the determination result, the ZC outputs the dynamic test authorization instruction to the on-board controller.

The state testing method for a rail vehicle provided in the present disclosure can realize simultaneous state testing of multiple rail vehicles on a same station track, which reduces the occupied station tracks, and improves the operating efficiency and the safety of the rail vehicles.

Figure 3:
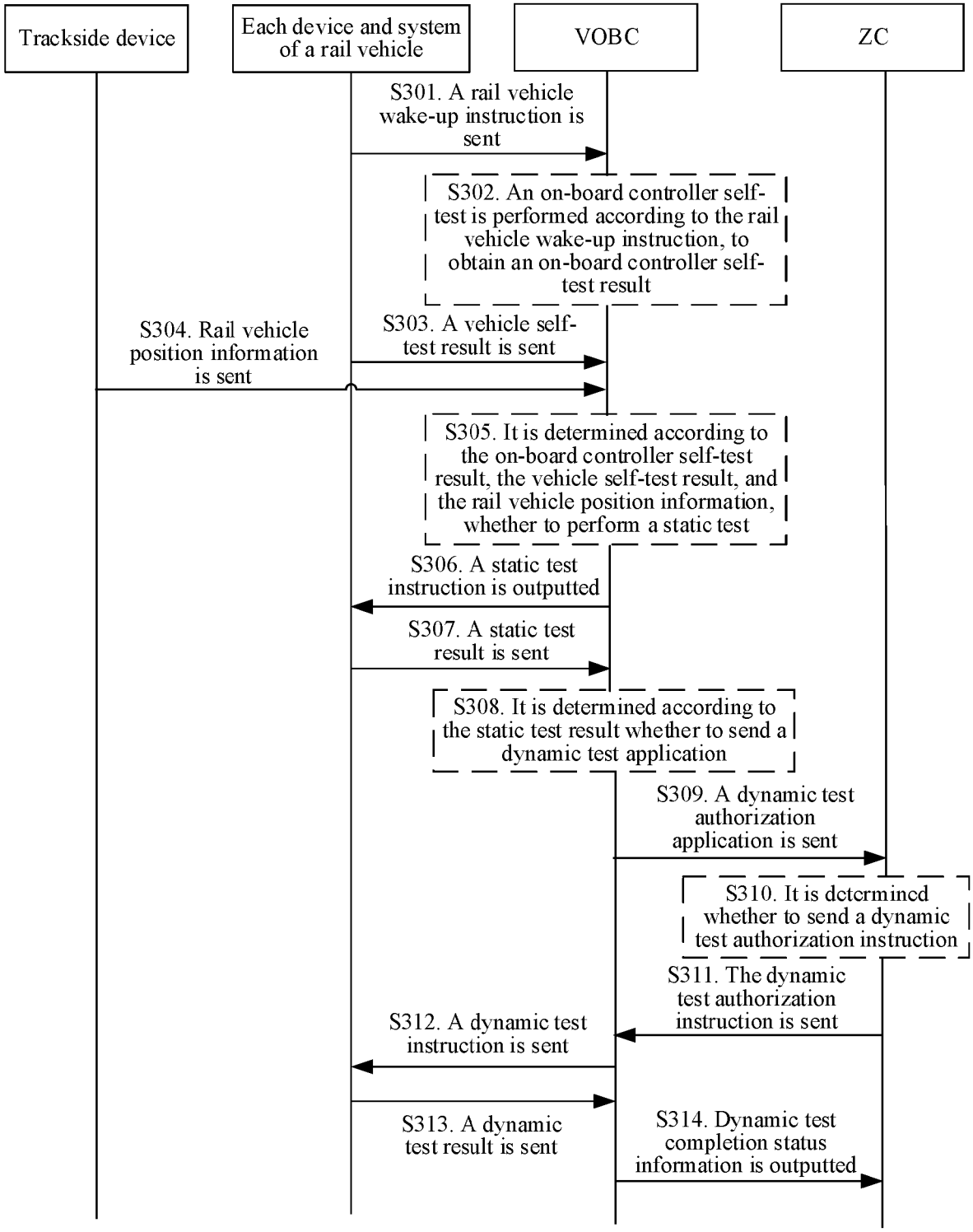
FIG. 3 is a schematic diagram of a state testing method for a rail vehicle according to a specific embodiment of the present disclosure.

In a specific embodiment of the present disclosure, as shown in FIG. 3, each device and system of the rail vehicle in FIG. 3 may be an ATS, an automatic train protection system (ATP), a TCMS, or the like. The massive devices and systems on the rail vehicle are not enumerated herein.

In a specific embodiment of the present disclosure, as shown in FIG. 3, the state testing method for a rail vehicle includes the following steps:

S301: A rail vehicle wake-up instruction is sent.

Before a state test of a rail vehicle, an automatic train supervision (ATS) needs to deliver a wake-up instruction to a wake-up from sleep module according to a dispatch/departure plan or manually. All trains on a same station track should be simultaneously woken up. After receiving a wake-up command delivered by the ATS, a wake-up from sleep module sends the wake-up instruction to the vehicles through a hard wire to power on all of the trains, and also sends the wake-up instruction to an on-board controller, that is, the on-board controller receives the rail vehicle wake-up instruction.

S302: An on-board controller self-test is performed according to the rail vehicle wake-up instruction, to obtain an on-board controller self-test result.

The content of this step has been described in detail in step S102, and therefore is not repeated herein.

S303: A vehicle self-test result is sent.

During wake-up, a power-on self-test is required to be performed on both the on-board controller and the vehicle. The power-on self-test of the vehicle is completed through the TCMS. After completing the power-on self-test of the vehicle, the TCMS sends a result of the power-on self-test of the vehicle to the on-board controller.

S304: Rail vehicle position information is sent.

The rail vehicle position information is sent to the on-board controller by a trackside device, which is mainly performed by a wake-up from sleep transponder in the trackside device. Before the static test, it is necessary to test whether a position of the rail vehicle is correct. It is determined whether a position of the rail vehicle in an anti-power-down area is the same as a position obtained by the wake-up from sleep transponder. If the position is the same and is within a sleep window, the static test is performed. Otherwise, a wake-up failure is outputted.

S305: It is determined according to the on-board controller self-test result, the vehicle self-test result, and the rail vehicle position information, whether to perform a static test.

In some embodiments, the on-board controller determines whether the rail vehicle satisfies a static test condition. The static test condition includes but is not limited to: the on-board controller and the vehicle both succeed in the power-on self-test, the rail vehicle is parked in the sleep window and in the correct position, and there is no abnormality in the communication of the on-board controller. When determining that the rail vehicle satisfies the static test condition, the on-board controller outputs the static test instruction, causing the rail vehicle to perform the static test. When the on-board controller determines that the rail vehicle does not satisfy the static test condition, the static test cannot be performed.

S306: A static test instruction is outputted.

When the on-board controller determines that a static test can be performed, the on-board controller sends the static test instruction to each device and system on the rail vehicle to perform a static test. The content of the static test has been described in detail in step S105, and therefore is not repeated herein.

S307: A static test result is sent.

After each device and system on the rail vehicle completes the static test, the static test result is sent to the on-board controller.

S308: It is determined according to the static test result whether to send a dynamic test application.

Further, two static test results may be generated. When the static test succeeds, a dynamic test instruction may be outputted. When the static test fails, a static test failure instruction is outputted, all fault information is outputted, and the fault information is sent to the ATS. The ATS receives and forwards the information to the dispatch center. The dispatch center displays the static test result and all of the fault information during the test, causing the maintenance personnel to perform corresponding maintenance.

S309: A dynamic test authorization application is sent.

When the static test succeeds, the on-board controller sends the dynamic test application to the ZC.

S310: It is determined whether to send a dynamic test authorization instruction.

When receiving the dynamic test application sent by the on-board controller, the ZC needs to determine whether to send the dynamic test authorization instruction. That is to say, the premise of sending the dynamic test authorization instruction is to satisfy a determination as to a dynamic test condition.

An important determination condition in the determination as to a dynamic test condition is dynamic test completion status information of adjacent trains. The specific determination as to a dynamic test condition is as follows:

the current rail vehicle satisfies a condition for the dynamic test when none of the adjacent rail vehicles sends the dynamic test authorization application;

the current rail vehicle does not satisfy the condition for the dynamic test when any of the adjacent rail vehicles sends the dynamic test authorization application but does not send the dynamic test completion status information; and the current rail vehicle satisfies the condition for the dynamic test when all of the adjacent rail vehicles send the dynamic test authorization application and send the dynamic test completion status information.

S311: The dynamic test authorization instruction is sent.

After step S310, it is determined that a dynamic test can be performed. Therefore, the ZC sends the dynamic test authorization instruction to the on-board controller.

S312: A dynamic test instruction is sent.

After receiving the dynamic test authorization instruction sent by the ZC, the on-board controller sends the dynamic test instruction to each device and system on the rail vehicle, causing the rail vehicle to perform the dynamic test.

S313: A dynamic test result is sent.

After each device and system on rail vehicle completes the dynamic test, the dynamic test result is sent to the on-board controller.

S314: Dynamic test completion status information is outputted.

After receiving the dynamic test result, the on-board controller sends the dynamic test completion status information to the ZC. A determination process is performed herein. The on-board controller determines whether the dynamic test result indicates a success. If the dynamic test result indicates a failure, a dynamic test failure instruction is outputted, all fault information is outputted, and the fault information is sent to the ATS. The ATS receives and forwards the information to a dispatch center. The dispatch center displays the dynamic test result and all of the fault information during the test, causing maintenance personnel to perform corresponding maintenance.

If the dynamic test result indicates a success, the dynamic test completion status information is sent to the ZC.

When determining whether dynamic test is required for the trains adjacent to the current train, the ZC needs to use the dynamic test completion status information of the current train. The content has been described in detail in step S109, and therefore is not repeated herein.

Therefore, during wake-up from sleep testing of multiple rail vehicles on a same station track of the rail vehicle, the testing efficiency is higher, that is, the wake-up efficiency is higher. In a specific embodiment, 5 rail vehicles exist on the same station track, namely, a rail vehicle 1, a rail vehicle 2, a rail vehicle 3, a rail vehicle 4, and a rail vehicle 5. In the related art, a wake-up from sleep test is required to be performed on the rail vehicles 1 to 5 successively. If testing of one rail vehicle requires t seconds, 5t seconds in total are required. However, in the method provided in the embodiments of the present disclosure, the wake-up from sleep test may be simultaneously performed on the rail vehicle 1, the rail vehicle 3, and the rail vehicle 5, which spends t seconds. After the wake-up from sleep test is completed for the rail vehicle 1, the rail vehicle 3, and the rail vehicle 5, the wake-up from sleep test is simultaneously performed on the rail vehicle 2 and the rail vehicle 4, which spends t seconds. That is to say, a total of 2t seconds are spent. Therefore, the wake-up from sleep test time is significantly reduced, thereby improving the operating efficiency. In addition, in the related art, if the wake-up from sleep test is simultaneously performed on the five rail vehicles, five different wake-up from sleep station tracks are occupied. However, in the method provided in the embodiments of the present disclosure, performing a wake-up from sleep test on the five rail vehicles occupies only one wake-up from sleep station track. Therefore, the occupied station tracks are reduced.

Figure 4:
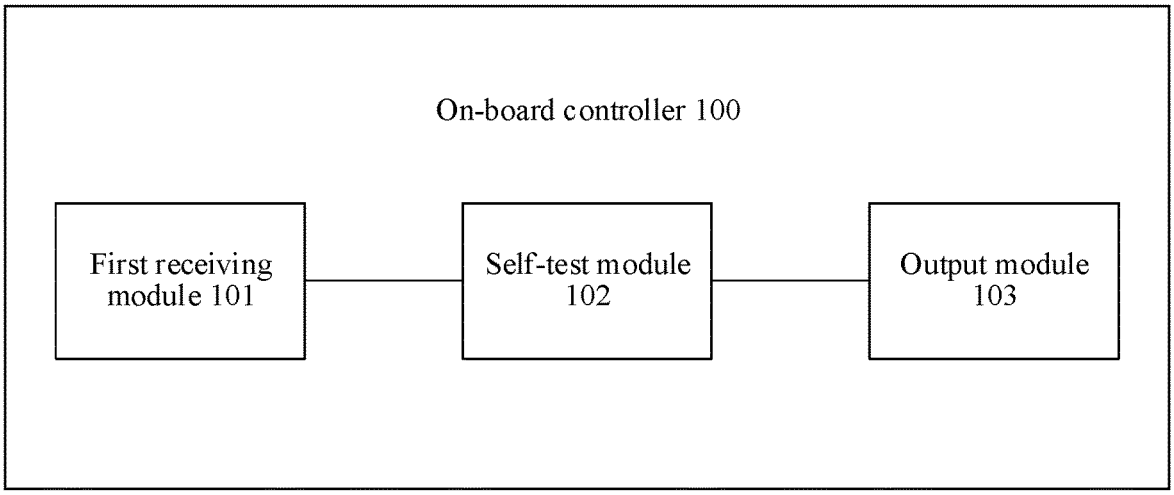
FIG. 4 is a schematic diagram of an on-board controller according to an embodiment of the present disclosure.

As shown in FIG. 4, the present disclosure further provides an on-board controller 100. The on-board controller 100 includes a first receiving module 101, a self-test module 102, and an output module 103.

The first receiving module 101 is configured to receive a rail vehicle wake-up instruction, rail vehicle position information, an on-board controller self-test result, a vehicle self-test result, a static test result, and a dynamic test result.

The self-test module 102 is configured to perform an on-board controller self-test according to the rail vehicle wake-up instruction.

The output module 103 is configured to: output a static test instruction according to the on-board controller self-test result, the vehicle self-test result, and the rail vehicle position information, causing the rail vehicle to perform a static test; output a dynamic test instruction according to the static test result and the rail vehicle position information, causing the rail vehicle to perform a dynamic test; and output dynamic test completion status information according to the dynamic test result, and update the dynamic test completion status information to a determination as to a dynamic test condition of other rail vehicles adjacent to the rail vehicle in real time through a ZC.

The on-board controller 100 completes the state test of the rail vehicle through the cooperation of the first receiving module 101, the self-test module 102, and the output module 103, and the on-board controller 100 can affect the dynamic test authorization of the adjacent rail vehicles through the dynamic test completion status information, so as to ensure the security of the dynamic test of the adjacent rail vehicles.

Figure 5:
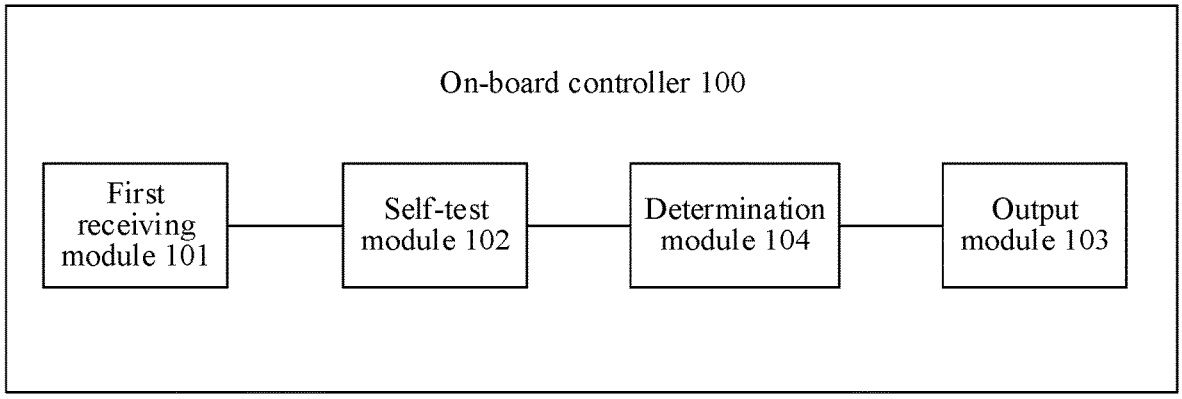
FIG. 5 is a schematic diagram of another on-board controller according to an embodiment of the present disclosure.

In some embodiments, as shown in FIG. 5, the on-board controller 100 further includes a determination module 104. The determination module 104 is configured to determine whether the self-test of the on-board controller 100 succeeds. When the on-board controller 100 succeeds in the self-test, the first receiving module 101 receives the vehicle self-test result. When the on-board controller 100 fails the self-test, the output module 103 outputs self-test failure information and outputs a safety braking instruction.

In some embodiments, the output module 103 is further configured to send a dynamic test authorization application.

In some embodiments, the output module 103 is further configured to output dynamic test completion status information. The rail vehicle can affect the determination of the dynamic test of the adjacent rail vehicles by outputting the dynamic test completion status information, so as to ensure the safety of the dynamic test of the adjacent rail vehicles. How the dynamic test completion status information affects the determination of adjacent rail vehicles has been described in detail in the above state testing method for a rail vehicle, and therefore is not repeated herein.

It may be understood that, for specific implementations of the functional blocks included in the on-board controller in FIG. 4 and FIG. 5 and the corresponding beneficial effects, refer to the specific description of the embodiment in FIG. 1 or FIG. 3. The details are not repeated herein.

Figure 6:
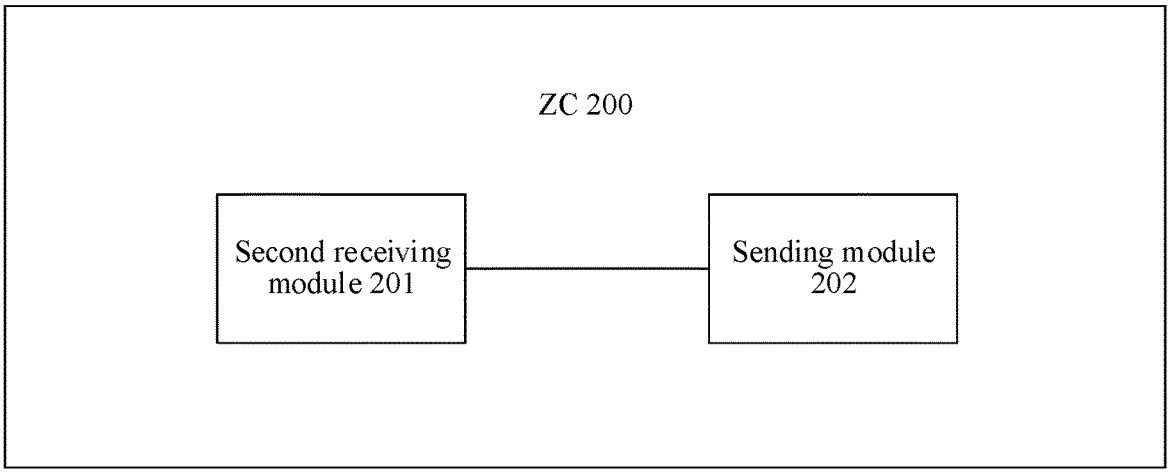
FIG. 6 is a schematic diagram of a zone controller (ZC) according to an embodiment of the present disclosure.

As shown in FIG. 6, the present disclosure further provides a ZC 200. The ZC 200 includes a second receiving module 201 and a sending module 202.

The second receiving module 201 is configured to receive dynamic test completion status information, where the dynamic test completion status information is obtained by: receiving, by an on-board controller, a rail vehicle wake-up instruction to perform an on-board controller self-test, outputting a static test instruction according to an on-board controller self-test result and a received vehicle self-test result, outputting a dynamic test instruction according to a received static test result and received rail vehicle position information, and obtaining the dynamic test completion status information according to a received dynamic test result.

The sending module 202 is configured to send the dynamic test completion status information to other rail vehicles adjacent to the rail vehicle.

In some embodiments, the second receiving module 201 is further configured to receive a dynamic test authorization application.

Figure 7:
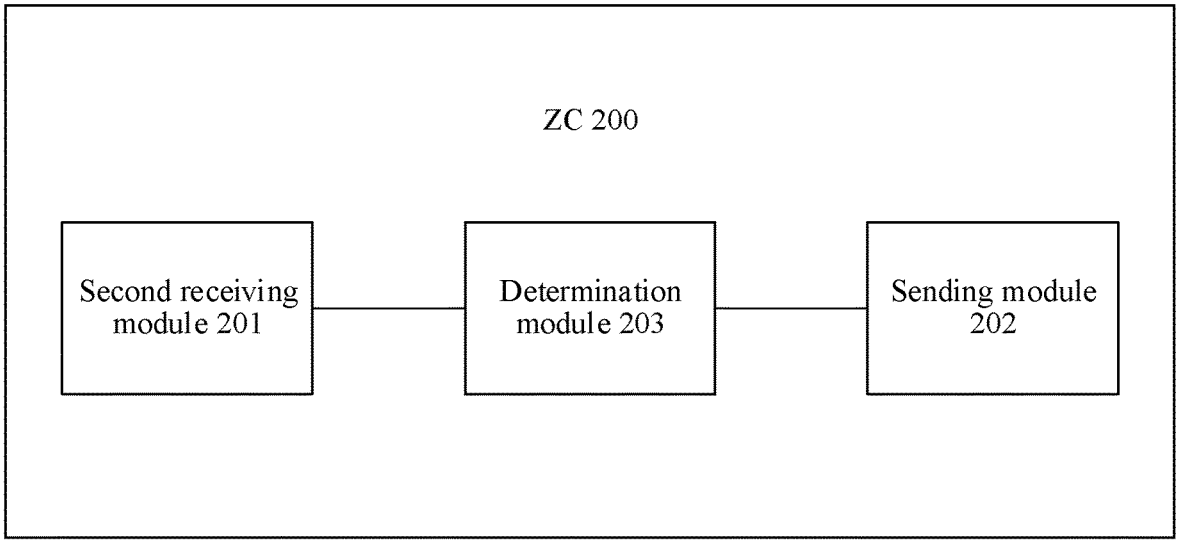
FIG. 7 is a schematic diagram of another ZC according to an embodiment of the present disclosure.

In some embodiments, as shown in FIG. 7, the ZC 200 further includes a determination module 203. The determination module 203 is configured to determine whether the rail vehicle satisfies a determination as to a dynamic test condition.

In some embodiments, the sending module 202 is further configured to output a dynamic test authorization instruction according to a dynamic test determination result.

It may be understood that, for specific implementations of the functional blocks included in the on-board controller in FIG. 6 and FIG. 7 and the corresponding beneficial effects, refer to the specific description of the embodiment in FIG. 2 or FIG. 3. The details are not repeated herein.

Figure 8:
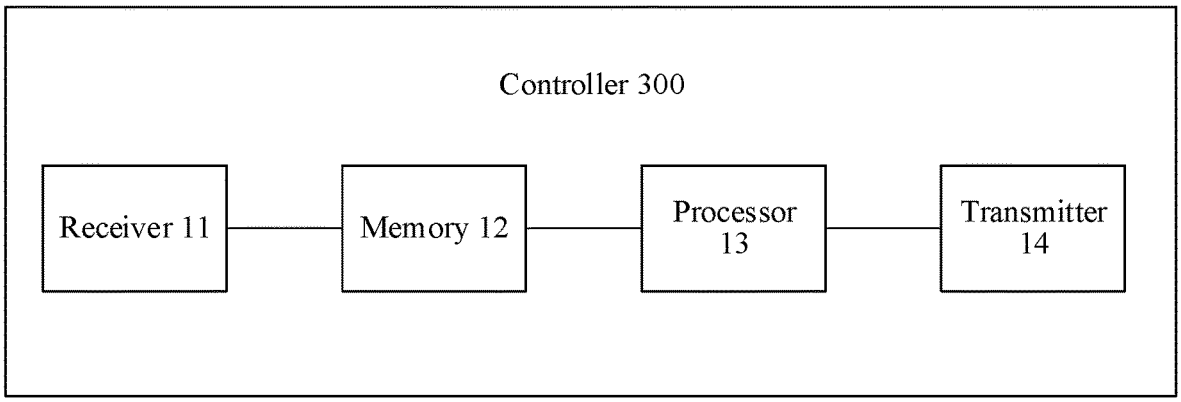
FIG. 8 is a schematic diagram of a controller according to an embodiment of the present disclosure.

As shown in FIG. 8, the present disclosure provides a controller 300, including a receiver 11, a memory 12, a processor 13, a transmitter 14, and a computer program stored in the memory 12 and executable on the processor 13. When the processor 13 executes the computer program, any step in the state testing method for a rail vehicle in the above embodiments is implemented.

In some embodiments, a computer-readable storage medium is provided. A computer program is stored on the computer-readable storage medium. When the computer program is executed by a processor, any step in the state testing method for a rail vehicle in the above embodiments is implemented.

Other compositions and operations of the state testing method for a rail vehicle and the on-board controller in the embodiments of the present disclosure are known to those of ordinary skill in the art, and therefore are not described in detail herein.

A person of ordinary skill in the art may understand that some or all procedures in the foregoing method embodiments may be implemented by a computer program instructing related hardware. The computer program may be stored in a non-volatile computer-readable storage medium, and when the computer program is executed, the procedures of the foregoing method embodiments may be performed. Any reference to a memory, a storage, a database, or another medium used in the embodiments provided in the present disclosure may include a non-volatile and/or volatile memory. The non-volatile memory may include a read-only memory (ROM), a programmable ROM (PROM), an electrically programmable ROM (EPROM), an electrically erasable programmable ROM (EEPROM), a flash memory, or the like. The volatile memory may include a random access memory (RAM) or an external cache. As an illustration instead of a limitation, the RAM is available in various forms, such as a static RAM (SRAM), a dynamic RAM (DRAM), a synchronous DRAM (SDRAM), a double data rate SDRAM (DDRSDRAM), an enhanced SDRAM (ESDRAM), a synchronization link (Synchlink) DRAM (SLDRAM), a rambus direct RAM (RDRAM), a direct rambus dynamic RAM (DRDRAM), and a rambus dynamic RAM (RDRAM).

In the state testing method for a rail vehicle, dynamic test completion status information is used as a determination condition for a dynamic test of adjacent rail vehicles, which ensures the safety of the dynamic test of the rail vehicles, and realizes safe and effective dynamic testing of multiple trains on a same station track, thereby improving the operating efficiency of the rail vehicles.

In the state testing method for a rail vehicle provided in the embodiments of the present disclosure, the dynamic test completion status information is used as a determination condition for the dynamic test of the adjacent rail vehicles, which ensures the safety of the dynamic test of the rail vehicles. In addition, the method can be used for state testing of the multiple rail vehicles on the same station track during wake-up, which improves the operating efficiency of the rail vehicles.

A person skilled in the art may clearly understand that, for the purpose of convenient and brief description, only division of the foregoing function units is used as an example for description. In the practical application, the functions may be allocated to and completed by different function modules according to requirements. That is, an internal structure of the device is divided into different functional units or modules, to complete all or some of the functions described above.

The foregoing embodiments are merely intended for describing the technical solutions of the present disclosure, but not for limiting the present disclosure. Although the present disclosure is described in detail with reference to the foregoing embodiments, it is to be understood by a person of ordinary skill in the art that they may still make modifications to the technical solutions described in the foregoing embodiments or make equivalent replacements to some technical features thereof, without departing from the spirit and scope of the technical solutions of the embodiments of the present disclosure, which being included in the protection scope of the present disclosure.

In the description of this specification, the description of the reference terms such as "an embodiment", "some embodiments", "exemplary embodiments", "example", "specific example", or "some examples" means that the specific features, structures, materials or characteristics described with reference to the embodiment or example are included in at least one embodiment or example of the present disclosure. In this specification, exemplary descriptions of the foregoing terms do not necessarily refer to the same embodiment or example. In addition, the described specific features, structures, materials, or characteristics may be combined in a proper manner in any one or more of the embodiments or examples.

Although the embodiments of the present disclosure have been shown and described, a person of ordinary skill in the art should understand that various changes, modifications, replacements, and variations may be made to the embodiments without departing from the principles and purpose of the present disclosure, and the scope of the present disclosure is as defined by the appended claims and their equivalents.

What is claimed is:

1. A state testing method for a rail vehicle, for state testing of a plurality of rail vehicles on a same station track during wake-up, comprising:

receiving a rail vehicle wake-up instruction;

performing an on-board controller self-test according to the rail vehicle wake-up instruction, to obtain an on-board controller self-test result;

receiving a vehicle self-test result;

receiving rail vehicle position information;

outputting a static test instruction according to the on-board controller self-test result, the vehicle self-test result, and the rail vehicle position information, causing the rail vehicle to perform a static test;

receiving a static test result;

outputting a dynamic test instruction according to the static test result and the rail vehicle position information, causing the rail vehicle to perform a dynamic test;

receiving a dynamic test result; and outputting dynamic test completion status information according to the dynamic test result, and updating the dynamic test completion status information to a determination as to a dynamic test condition of other rail vehicles adjacent to the rail vehicle in real time through a zone controller (ZC).

2. The state testing method for a rail vehicle according to claim 1, wherein the performing an on-board controller self-test according to the rail vehicle wake-up instruction, to obtain an on-board controller self-test result comprises:

the on-board controller self-test result indicating a failure; and outputting on-board controller self-test failure information to a dispatch center and outputting a safety braking instruction to the rail vehicle.

3. The state testing method for a rail vehicle according to claim 1, further comprising:

the on-board controller self-test result indicating a success; and outputting and retaining on-board controller self-test success information.

4. The state testing method for a rail vehicle according to claim 1, further comprising:

the on-board controller self-test result and the vehicle self-test result both indicating a success; and sending activation information to a cab of the rail vehicle.

5. The state testing method for a rail vehicle according to claim 1, further comprising:

receiving, within a preset time, an activation signal fed back by the cab, causing the rail vehicle to perform the static test; and maintaining a braking instruction and outputting the static test instruction.

6. The state testing method for a rail vehicle according to claim 1, further comprising:

receiving, within a preset time, no activation signal fed back by the cab; and feeding back fault information to the dispatch center.

7. The state testing method for a rail vehicle according to claim 1, wherein the outputting a static test instruction according to the on-board controller self-test result, the vehicle self-test result, and the rail vehicle position information, causing the rail vehicle to perform a static test comprises:

the on-board controller self-test result and the vehicle self-test result indicating a success and the rail vehicle position information being correct; and outputting the static test instruction and causing the rail vehicle to perform the static test.

8. The state testing method for a rail vehicle according to claim 1, wherein the outputting a dynamic test instruction according to the static test result and the rail vehicle position information, causing the rail vehicle to perform a dynamic test comprises:

the static test succeeding and the rail vehicle position information being reliable;

sending a dynamic test authorization application to the ZC; and receiving a dynamic test authorization instruction, and outputting the dynamic test instruction, causing the rail vehicle to perform the dynamic test.

9. A state testing method for a rail vehicle, for state testing of a plurality of rail vehicles on a same station track during wake-up, comprising:

receiving dynamic test completion status information, wherein the dynamic test completion status information is obtained by: receiving, by an on-board controller, a rail vehicle wake-up instruction to perform an on-board controller self-test, outputting a static test instruction according to an on-board controller self-test result and a received vehicle self-test result, outputting a dynamic test instruction according to a received static test result and received rail vehicle position information, and obtaining the dynamic test completion status information according to a received dynamic test result; and sending the dynamic test completion status information to other rail vehicles adjacent to the rail vehicle.

10. The state testing method for a rail vehicle according to claim 9, further comprising:

receiving a dynamic test authorization application;

determining whether the rail vehicle satisfies a determination as to a dynamic test condition;

receiving a dynamic test determination result; and outputting a dynamic test authorization instruction according to the dynamic test determination result.

11. The state testing method for a rail vehicle according to claim 10, wherein in a case that positions of the other rail vehicles adjacent to the rail vehicle are reliable, the determination as to a dynamic test condition comprises:

none of the other rail vehicles adjacent to the rail vehicle sending the dynamic test authorization application; and the current rail vehicle satisfying a condition for the dynamic test.

12. The state testing method for a rail vehicle according to claim 10, wherein in a case that positions of the other rail vehicles adjacent to the rail vehicle are reliable, the determination as to a dynamic test condition comprises:

any of the other rail vehicles adjacent to the rail vehicle sending the dynamic test authorization application but not sending the dynamic test completion status information; and the current rail vehicle not satisfying the condition for the dynamic test.

13. The state testing method for a rail vehicle according to claim 10, wherein in a case that positions of the other rail vehicles adjacent to the rail vehicle are reliable, the determination as to a dynamic test condition comprises:

all of the other rail vehicles adjacent to the rail vehicle sending the dynamic test authorization application and sending the dynamic test completion status information; and the current rail vehicle satisfying the condition for the dynamic test.

14. An on-board controller, comprising:

a first receiving module, configured to receive a rail vehicle wake-up instruction, rail vehicle position information, an on-board controller self-test result, a vehicle self-test result, a static test result, and a dynamic test result;

a self-test module, configured to perform an on-board controller self-test according to the rail vehicle wake-up instruction; and an output module, configured to: output a static test instruction according to the on-board controller self-test result, the vehicle self-test result, and the rail vehicle position information, causing a rail vehicle to perform a static test; output a dynamic test instruction according to the static test result and the rail vehicle position information, causing the rail vehicle to perform a dynamic test; and output dynamic test completion status information according to the dynamic test result, and update the dynamic test completion status information to a determination as to a dynamic test condition of other rail vehicles adjacent to the rail vehicle in real time through a zone controller (ZC).

15. A controller, comprising a receiver, a memory, a processor, a transmitter, and a computer program stored in the memory and executable on the processor, wherein when the processor executes the computer program, the state testing method for a rail vehicle according to claim 1.

16. A computer-readable storage medium, storing a computer program, wherein when the computer program is executed by a processor, the state testing method for a rail vehicle according to claim 1.

* * * * *